US005369842A

United States Patent [19]

Beatty

[11] Patent Number: 5,369,842

[45] Date of Patent: Dec. 6, 1994

[54] "HINGE PLATE FOR A REFRIGERATOR"

[75] Inventor: Scott M. Beatty, Fort Smith, Ark.

[73] Assignee: Whirlpool Corporation, Benton Harbor, Mich.

[21] Appl. No.: 109,958

[22] Filed: Aug. 23, 1993

[51] Int. Cl.[5] ..... E05F 1/02

[52] U.S. Cl. ..... 16/317

[58] Field of Search ..... 16/317, 318, 314, 315, 16/316, 387, 390, 392, 247

[56] References Cited

U.S. PATENT DOCUMENTS

| | | | |
|---|---|---|---|
| 2,790,198 | 4/1957 | Schoen et al. | 16/387 |
| 2,904,824 | 9/1959 | Kuehl | 16/318 |
| 3,564,771 | 2/1971 | Reynolds | 16/390 |
| 3,628,845 | 12/1971 | Grimm | 16/317 |
| 3,648,327 | 3/1972 | Edeus | 16/317 |
| 3,722,031 | 3/1973 | Bourgeois | 16/317 |
| 4,090,274 | 5/1978 | Bourgeois | 16/317 |
| 4,864,691 | 9/1989 | Gidseg et al. | 16/317 |
| 4,930,184 | 6/1990 | Kristmanson | 16/387 |

*Primary Examiner*—P. Austin Bradley
*Assistant Examiner*—Chuck Y. Mah
*Attorney, Agent, or Firm*—Thomas J. Roth

[57] ABSTRACT

A refrigerator includes an external wrapper defining a refrigerated compartment. The external wrapper overlies a support frame, and at least one door is movable about a hinge point to obtain access to the refrigerated compartment. The door is supported by a molded plastic hinge which is integrally formed to include a hinge pin, cam and door stop. The molded plastic hinge is formed so as to eliminate the need for shims, wherein a relieved area on that portion of the hinge plate overlying the external wrapper compensates for the width of the sheet material forming the external wrapper.

4 Claims, 2 Drawing Sheets

"HINGE PLATE FOR A REFRIGERATOR"

BACKGROUND OF THE INVENTION

The present invention is directed to an improved hinge plate for a refrigerator and particularly to a hinge plate mountable on a refrigerator at a location where the external wrapper partially overlies the support frame for the refrigerator. The improved hinge plate further includes an integral hinge pin and cam, and a pair of integrally formed ribs for enhanced strength.

The use of a hinge plate in a refrigerator which includes an upright pin and a cam mechanism for providing a plurality of door positions is well known.

U.S. Pat. No. 4,090,274, Bourgeois, discloses a typical known hinge plate assembly. An L-shaped cabinet bracket is secured to a refrigerator cabinet. A lower hinge bushing which includes a plurality of upwardly projecting equally circumferentially spaced cam lobes is secured to the L-bracket using a threaded fastener. A hinge pin projects upwardly from the lower hinge bushing and is received within an upper hinge bushing which is secured to the refrigerator door. A drawback to the hinge plate as shown is the inability to mount the L-shaped bracket to the refrigerator at the line where the wrapper terminates and adjoins the deck rails, without use of shims. An additional drawback is the number of parts required to provide the complete assembly, which adds not only to inventory tracking requirements, but labor costs as well.

U.S. Pat. No. 3,628,845, Grimm, discloses another typical hinge plate assembly. A hinge plate includes a horizontal leg and a vertical leg, and a combination hinge pin and cam which is inserted into a hole through the horizontal leg and secured thereto by brazing or other known securing means. The hinge pin inserts into an upper bearing member secured to the refrigerator door. A disadvantage to the design is the inability to mount the plate to the refrigerator at the line where the wrapper terminates and adjoins the deck rails, without use of shims. An additional drawback is the number of parts required to provide the complete assembly, and the labor required for assembly.

Whirlpool publication No. 1124801, dated July 1992, discloses another previous hinge plate assembly. An L-shaped metal hinge plate includes a horizontal leg and a vertical leg. A metal hinge pin is secured to the horizontal leg by known means. Upper and lower cams are secured to the refrigerator door and the hinge plate, respectively, by threaded fasteners. The hinge plate is mounted to the refrigerator, with a resilient shim inserted behind the hinge plate to compensate for the height difference between the external wrapper and the support frame. A disadvantage to the design is the inability to mount the plate to the refrigerator at the line where the wrapper terminates and adjoins the support frame, without use of shims. An additional drawback is the number of parts required to provide the complete assembly, and the labor required for assembly.

SUMMARY OF THE INVENTION

The present invention overcomes the disadvantages of previous refrigerator door hinge plates by providing a hinge plate which includes a bi-level mounting surface mountable on a refrigerator at a location where the external wrapper partially overlies the support frame or deck rails for the refrigerator. Further, the present invention comprises a molded hinge plate which includes an integrally formed hinge pin and cam. Additionally, the present invention includes a hinge plate which includes a pair of ribs or bights for added strength.

Another advantage of the invention is the inclusion of a bi-level mounting surface, thereby providing the capability to mount the hinge plate to the refrigerator at the line where the wrapper terminates and adjoins the deck rails, without use of shims.

An advantage of the invention as disclosed herein is the reduction of parts included in the hinge plate to one, thereby reducing the need for inventory tracking, and lowering the overall cost of assembly of the refrigerator.

Yet a further advantage of the invention is the ability to form the hinge plate from a plastic or other synthetic material, thereby reducing both cost and weight of the hinge plate.

DETAILED DESCRIPTION OF THE PREFERRED EMBODIMENTS

Figure 1:
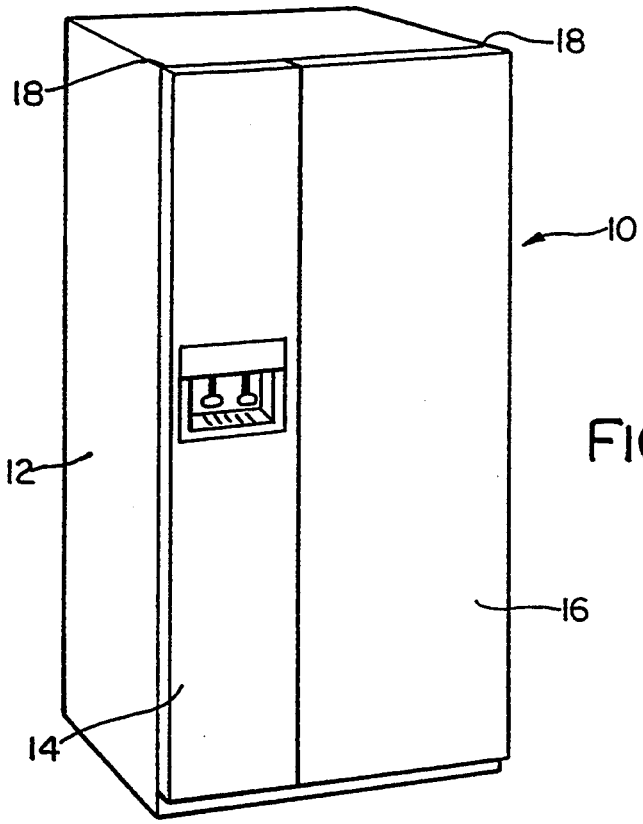
FIG. 1 is a front perspective view of a refrigerator in accordance with the present invention.

A refrigerator 10, as shown in FIG. 1, includes an external wrapper 12 enclosing refrigerated compartments having front-facing openings covered by freezer compartment door 14 and refrigerator compartment door 16. The present invention is disclosed for use in a refrigerator type commonly known as a side-by-side refrigerator, however, it may also be used in other refrigerators, such as top-mount or bottom-mount freezer-style refrigerators, or upright freezers. Each of the doors 14 and 16 is pivotally secured to the refrigerator by an upper door hinge assembly 18, as shown in FIG. 1, and a lower door hinge assembly 19 as shown in FIG. 2.

Figure 2:
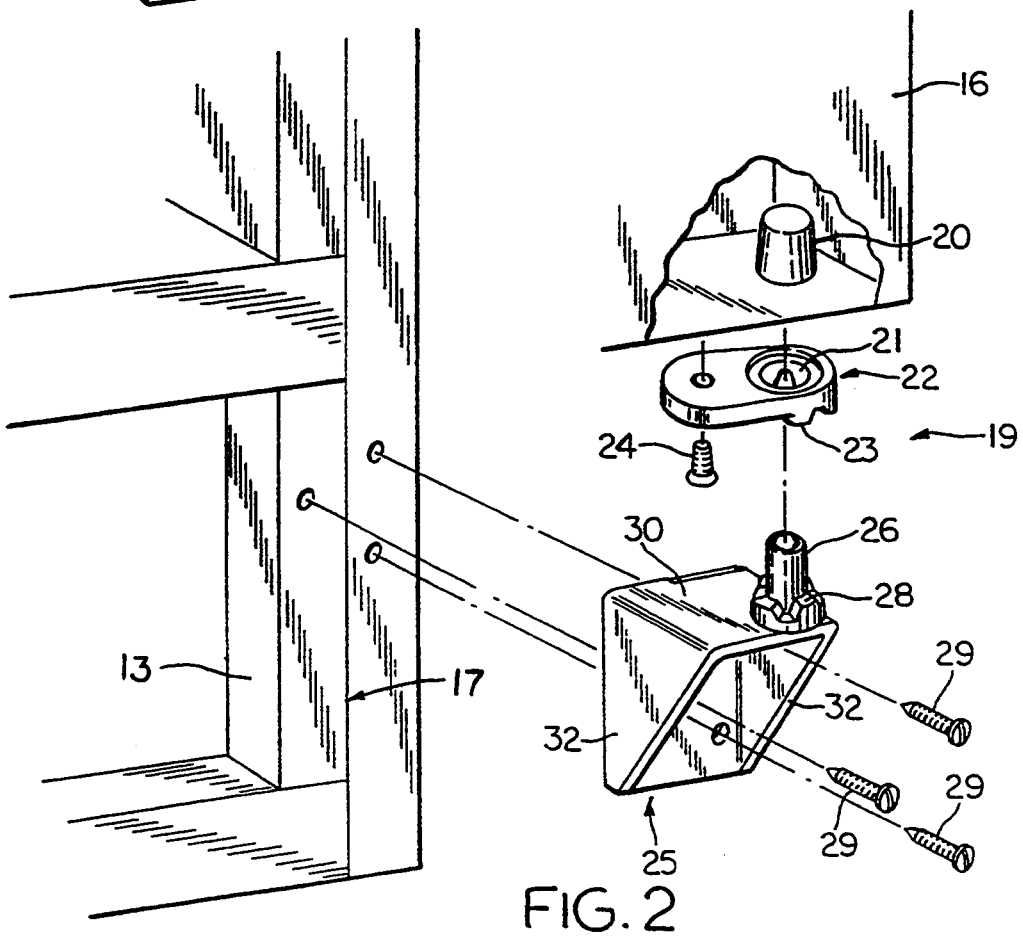
FIG. 2 is an exploded perspective view of a refrigerator in accordance with the present invention.
Figure 3:
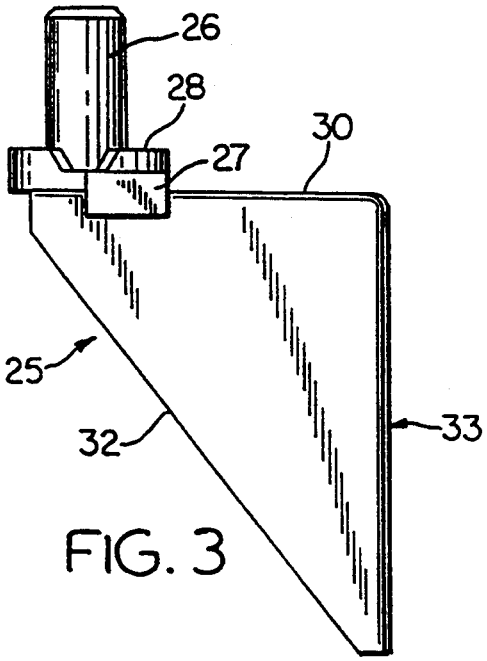
FIG. 3 is a side elevational view of the hinge plate of the refrigerator.
Figure 6:
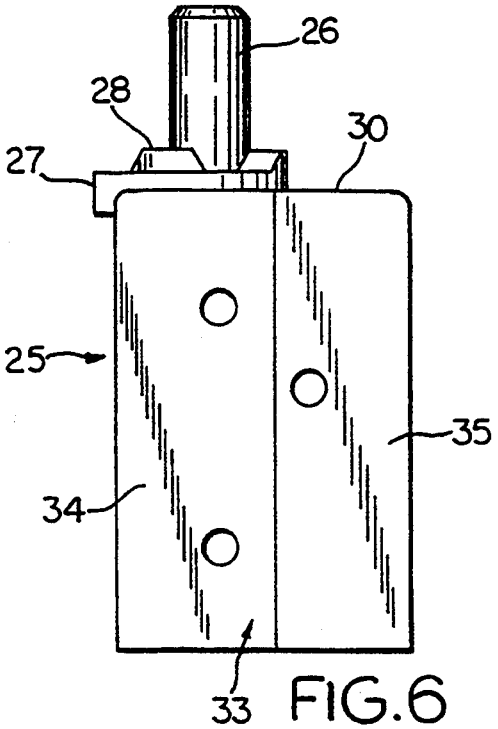
FIG. 6 is a rear elevational view of the hinge plate of the refrigerator.
Figure 4:
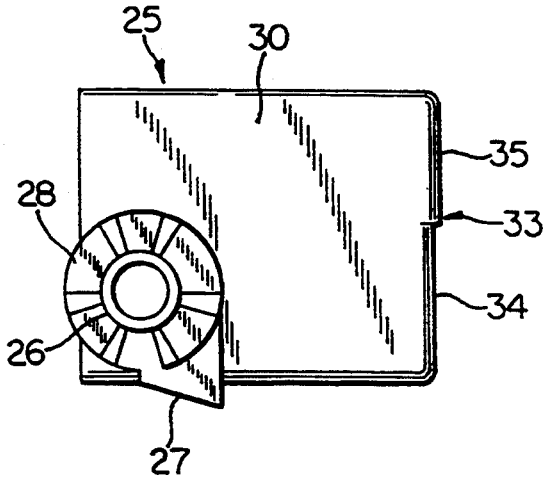
FIG. 4 is a top plan view of the hinge plate of the refrigerator.
Figure 5:
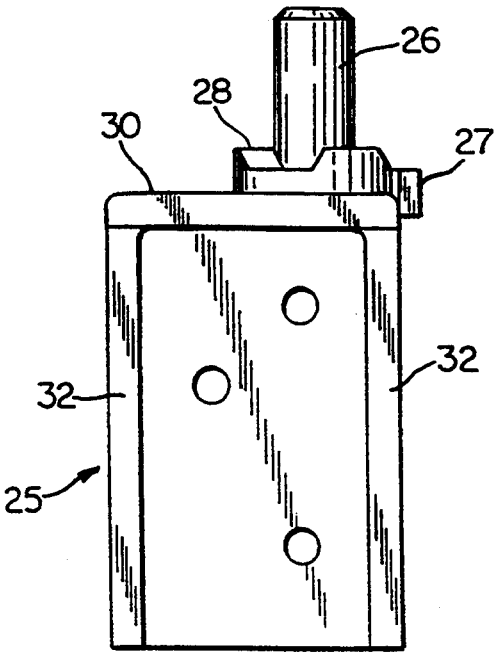
FIG. 5 is a front elevational view of the hinge plate of the refrigerator.

As disclosed in FIG. 2, refrigerator 10 includes a support frame 13 for supporting the refrigerator and adding structural rigidity thereto. External wrapper 12 partially overlies support frame 13 and, at the extreme outermost portion thereof, where the external wrapper 12 terminates, external wrapper 12 defines an edge or line 17.

As further shown in FIG. 2, refrigerator compartment door 16, for example, includes a thimble 20 for receiving a hinge pin, and preventing insulative foam (not shown) which is foamed-in-place from exiting the door 16 through the hole provided for the hinge pin. Hinge pin guide 22 includes a through hole 21, also for receiving the hinge pin, and cam follower 23. Hinge pin guide 22 is removably secured to the door 16 by a threaded screw fastener 24, or other conventional fastening means.

Hinge plate 25 includes an integral hinge pin 26, cam 28 and door stop 27 projecting upwardly from support surface 30, as shown in FIGS. 2–6. When assembled, hinge pin 26 projects through hinge pin guide 22 into refrigerator compartment door 16, to horizontally position refrigerator door 16 and enable it to pivot thereabout. Hinge plate 25 includes a pair of ribs or bights 32 to provide additional rigidity and strength.

In another aspect of the present invention, hinge plate 25 includes a mounting surface 33, for mounting hinge plate 25 to refrigerator 10 by means of conventional threaded screw fasteners 29. Mounting surface 33 includes a relieved portion 34 and a raised portion 35, for reasons as will be made evident. As contemplated herein, the relieved portion 34 is relieved to a depth equivalent to the thickness of external wrapper 12, which enables elimination of the previously required shim.

When fastened to refrigerator 10, relieved portion 34 overlies external wrapper 12. At the line 17 formed where the extreme outermost edge of external wrapper 12 overlies the support frame 13, a corresponding line is formed at the juncture of relieved portion 34 and raised portion 35 in mounting surface 33. Correspondingly, when fastened to refrigerator 10, raised portion 35 overlies support frame 13. As well, when hinge plate 25 is fastened to refrigerator 10, relieved portion 34 overlies external wrapper 12. Therefore, when hinge plate 25 is fastened to refrigerator 10, the hinge plate is necessarily correctly positioned relative to the refrigerator, without the use of shims as was previously required.

Hinge plate 25 is preferably formed as a single part made of high-strength plastic, such as polyphthalamide, 45% glass filled, which substance is known. By this combination of parts, and elimination of the hinge plate shim, greater dimensional accuracy is obtained, which improves door seal variables such as door gap, door inset and door height.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

What is claimed is:

1. In a refrigerator having an external wrapper partially overlying a support frame and defining a refrigerated cavity having an opening, and a hinged external door for covering said opening, a hinge plate locatable at an edge of said wrapper comprising:

an upstanding hinge pin for locating said door at a predetermined distance from said cavity;

a horizontal support member having a lower face and an upper face for supporting said external door at a predetermined height relative to said cavity;

said upstanding hinge pin projecting from a first end of said upper face of said horizontal support member;

a vertical support member having a front face and a rear face for securing said hinge plate to said refrigerator, said front face of said vertical support member being integrally formed with said horizontal support member at a second end thereof;

said rear face of said vertical support member including a horizontally offset relieved portion traversing at least a vertical extent of said rear face and extending from a side edge of said rear face to a predetermined point median said rear face of said vertical support member;

said horizontally offset relieved portion being alignable to overlie said external wrapper when said hinge plate is mounted in said refrigerator.

2. The hinge plate of claim 1, further including at least one bight formed between said lower face of said horizontal support member and said front face of said vertical support member.

3. The hinge plate of claim 1, further including a pair of bights formed between said lower face of said horizontal support member and said front face of said vertical support member.

4. The hinge plate of claim 3, wherein said hinge plate is formed of a molded plastic.

* * * * *